US008269477B2

(12) United States Patent
Jo

(10) Patent No.: US 8,269,477 B2
(45) Date of Patent: Sep. 18, 2012

(54) REFERENCE VOLTAGE GENERATION CIRCUIT

(75) Inventor: Eun Sang Jo, Bucheon-si (KR)

(73) Assignee: Dongbu HiTek Co., Ltd., Seoul (KR)

( * ) Notice: Subject to any disclaimer, the term of this patent is extended or adjusted under 35 U.S.C. 154(b) by 385 days.

(21) Appl. No.: 12/636,100

(22) Filed: Dec. 11, 2009

(65) Prior Publication Data

US 2010/0164466 A1 Jul. 1, 2010

(30) Foreign Application Priority Data

Dec. 29, 2008 (KR) ..... 10-2008-0135177

(51) Int. Cl.
*G05F 3/16* (2006.01)

(52) U.S. Cl. ..... 323/313; 323/901

(58) Field of Classification Search ..... 323/311, 323/312, 313, 316, 901; 327/539, 541
See application file for complete search history.

(56) References Cited

U.S. PATENT DOCUMENTS 4,673,851 A * 6/1987 Disser ..... 388/831
6,150,872 A * 11/2000 McNeill et al. ..... 327/539
7,215,180 B2 * 5/2007 Nagata et al. ..... 327/538
7,274,180 B2 * 9/2007 Itoh ..... 323/283
7,602,236 B2 * 10/2009 Jo ..... 327/539
7,659,705 B2 * 2/2010 Hung ..... 323/313
7,911,195 B2 * 3/2011 Draxelmayr ..... 323/313
8,008,966 B2 * 8/2011 Cho ..... 327/539
8,080,989 B2 * 12/2011 Jo ..... 323/313
8,093,881 B2 * 1/2012 Fujiyama ..... 323/313
2006/0006927 A1 * 1/2006 Nakada ..... 327/539

* cited by examiner

*Primary Examiner* — Adolf Berhane
(74) *Attorney, Agent, or Firm* — The Law Offices of Andrew D. Fortney; Andrew D. Fortney

(57) ABSTRACT

A reference voltage generation circuit is disclosed. The reference voltage generation circuit includes an operational amplifier configured to output a constant voltage in accordance with reference voltages input to first and second terminals of the operational amplifier, and a start-up circuit configured to initiate operation of the operational amplifier when the start-up circuit switches from an idle mode to an active mode, including a first transistor having a gate connected to an output of the operational amplifier, a source connected to a supply voltage, and a drain connected to a resistor, configured to supply a reference current to the resistor in accordance with the operational amplifier output, thereby generating the reference voltage.

18 Claims, 4 Drawing Sheets

REFERENCE VOLTAGE GENERATION CIRCUIT

This application claims the benefit of Korean Patent Application No. 10-2008-0135177, filed on Dec. 29, 2008, which is hereby incorporated by reference as if fully set forth herein.

BACKGROUND OF THE INVENTION

Field of the Invention

The present invention relates to a semiconductor integrated circuit, and more particularly, to a reference voltage generation circuit for generating a voltage of a predetermined range.

It is very important that the internal biasing reference voltage of a semiconductor integrated circuit is stably maintained, in order to secure the reliability of the entirety of a device using the semiconductor integrated circuit. That is, it is important that, even when an external supply voltage, the ambient temperature, or the manufacturing process varies, the semiconductor integrated circuit is not significantly affected by such a variation, in order to enable each element of the device to stably perform an intrinsic function thereof. To this end, a reference voltage generation circuit capable of supplying a stable and constant reference voltage is very beneficial.

Even in such a reference voltage generation circuit, however, there may be a factor causing the circuit itself to become unstable. Such a factor is mainly a variation in temperature, process/manufacturing condition, or external supply voltage.

As an example of such a reference voltage generation circuit, there is a band-gap reference voltage generation circuit. The band-gap reference voltage generation circuit generates a voltage (potential) in a predetermined range even when there is a variation in temperature, supply voltage, or process condition.

FIG. 1 is a circuit diagram illustrating a related band-gap reference voltage generation circuit.

Referring to FIG. 1, the related band-gap reference voltage generation circuit includes an operational amplifier for outputting a constant voltage in accordance with reference voltages respectively input to an first terminal (−) thereof and a second terminal (+) thereof, a first PMOS transistor PM1 for outputting a bias current corresponding to an output voltage from the operational amplifier 10, using a supply voltage VDD, and a reference voltage circuit 20 for supplying the reference voltages to the first terminal (−) and second terminal (+) of the operational amplifier 10, respectively, receiving the bias current from the first PMOS transistor PM1. The band-gap reference voltage generation circuit also includes a start-up circuit 30 for driving the entire circuit in a power-up operation, and an output terminal NO (Vout) arranged between the first PMOS transistor PM1 and the reference voltage circuit 20.

The first PMOS transistor PM1 is driven or biased in accordance with the output voltage of the operational amplifier 10. The first PMOS transistor PM1 includes a source connected to the supply voltage VDD, and a drain connected to the output terminal NO.

The first PMOS transistor PM1 supplies a bias current corresponding to the output voltage from the operational amplifier 10 to the reference voltage circuit 20.

The reference voltage circuit 20 is a temperature compensation circuit that includes bipolar transistors Q1, Q2 and resistors R1, R2, R3. The reference voltage circuit 20 includes a first resistor R1 and a first bipolar transistor Q1, which are connected in series between the output terminal NO and a ground voltage VSS. The reference voltage circuit 20 also includes a second resistor R2, a third resistor R3, and a second bipolar transistor Q2, which are also connected in series between the output terminal NO and the ground voltage VSS.

A first node N1 between the first resistor R1 and the first bipolar transistor Q1 is connected to the first terminal (−) of the operational amplifier 10.

A second node N2 between the second resistor R2 and the third resistor R3 is connected to the second terminal (+) of the operational amplifier 10.

The bases of the first and second bipolar transistors Q1 and Q2 are connected to the ground voltage VSS such that the first and second bipolar transistors Q1 and Q2 constitute a current mirror.

The emitter of the first bipolar transistor Q1 is connected to the first node N1, whereas the collector of the first bipolar transistor Q1 is connected to the ground voltage VSS.

The emitter of the second bipolar transistor Q2 is connected to the third resistor R3, whereas the collector of the second bipolar transistor Q2 is connected to the ground voltage VSS.

In the reference voltage circuit 20 having the above-mentioned configuration, first and second reference voltages are supplied to the first terminal (−) and second terminal (+) of the operational amplifier 10, respectively, as a certain current flows to the ground voltage potential VSS through the first and second bipolar transistors Q1 and Q2 connected in the form of a current mirror, in accordance with the resistance ratio(s) among the first to third resistors R1, R2, R3.

The operational amplifier 10 outputs a constant band voltage (Vband) in accordance with the reference voltages supplied from first and second nodes N1 and N2 of the reference voltage circuit 20.

A second PMOS transistor PM2 is connected to the supply voltage VDD, to supply the supply voltage VDD to the first PMOS transistor PM1 when the circuit is powered down (e.g., as controlled by complementary power-down signal pwdb).

The start-up circuit 30 includes a third PMOS transistor PM3 controlled in accordance with a power-down signal pwd and connected to the supply voltage VDD, and a fourth PMOS transistor PM4 connected, at the source thereof, to a drain of the third PMOS transistor PM3. The gate and drain of the fourth PMOS transistor PM4 are connected to each other. The start-up circuit 30 also includes first to third NMOS transistors NM1 to NM3 connected in series to the fourth PMOS transistor PM4 in the form of diodes, a fifth PMOS transistor PM5 for sourcing current to the output of the operational amplifier 10 in accordance with gate voltages of the first to third NMOS transistors NM1 to NM3, and a fourth NMOS transistor NM4 controlled in accordance with an inverted or complementary power-down signal pwdb and connected to the fifth PMOS transistor PM5 and the ground voltage VSS.

The start-up circuit 30 starts up the entire circuit when it is turned on, or is switched from an idle mode (e.g., a standby or sleep mode) to an active mode (normal mode). When the start-up circuit 30 is switched from the idle mode to the active mode, it wakes up the operational amplifier 10. The start-up circuit 30 also enables the band-gap reference voltage generation circuit have a stable wake-up point.

The related band-gap reference voltage generation circuit adds a voltage from by a proportional to absolute temperature (PTAT) circuit and the voltage of the base-emitter junction (typically having a negative temperature coefficient) to each other to output a stable reference voltage that is not affected by a variation in temperature.

Meanwhile, the operational amplifier 10 of the band-gap reference voltage generation circuit having the above-mentioned configuration includes two input transistors connected to the first terminal (−) and second terminal (+) of the operational amplifier 10. If the two input transistors are manufactured to have the same size, a stable voltage may be output from the operational amplifier 10. That is, the operational amplifier 10 may output a constant band voltage Vband in accordance with the supplied reference voltages.

However, if the two input transistors provided in the operational amplifier 10 have a mismatch of 0.11% or more, the operational amplifier 10 outputs a voltage of about 0.4V. In this case, the reference voltage generation circuit may not perform a desired reference voltage generation function.

FIG. 2 is a graph depicting band-gap output voltage characteristics of the related band-gap reference voltage generation circuit exhibited when the input transistors of the operational amplifier are mismatched.

As shown in FIG. 2, the related band-gap reference voltage generation circuit outputs a stable reference voltage when the two input transistors of the operational amplifier are realized in a process causing a mismatch A of 0%. However, when the two input transistors of the operational amplifier 10 have a mismatch B of 0.11% or more, the output voltage of the operational amplifier 10 cannot increase to 1.0V or more. In this case, the operational amplifier 10 outputs a reference voltage of about 0.4V. For this reason, the related band-gap reference voltage generation circuit cannot perform a desired reference voltage generation function.

In detail, in the related band-gap reference voltage generation circuit, the output of the operational amplifier 10 has a positive value when the start-up circuit is in an idle mode. When the start-up circuit 30 is switched from the idle mode to the active mode (normal mode), and the two input transistors of the operational amplifier 10 have a mismatch beyond an allowable range due to a variation in the manufacturing process, or the start-up circuit 30 does not operate normally, the output voltage of the operational amplifier 10 is not set within a band gap, and still has a positive value.

For this reason, the start-up circuit 30 slowly wakes up when it is switched from the idle mode to the active mode. As a result, the related reference voltage generation circuit may have a problem in that the operational amplifier 30 may not have a stable wake-up point due to the delayed wake-up time of the start-up circuit 30.

SUMMARY OF THE INVENTION

Accordingly, the present invention is directed to a reference voltage generation circuit that substantially obviates one or more problems due to limitations and disadvantages of the related art.

An object of the present invention is to provide a reference voltage generation circuit capable of achieving fast start-up when it is switched from an idle mode to a normal mode, and providing a stable band-gap output voltage.

Another object of the present invention is to provide a reference voltage generation circuit capable of supporting stable start-up when it is switched from an idle mode to a normal mode, and stably operating even when the characteristics of the elements of the reference voltage generation circuit vary due to processing mismatches.

Additional advantages, objects, and features of the invention will be set forth in part in the description which follows and in part will become apparent to those skilled in the art upon examination of the following or may be learned from practice of the invention. The objectives and other advantages of the invention may be realized and attained by the structure(s) particularly pointed out in the written description and claims hereof as well as the appended drawings.

To achieve these objects and other advantages and in accordance with the purpose(s) of the invention, as embodied and broadly described herein, a reference voltage generation circuit may comprise an operational amplifier configured to output a substantially constant voltage in accordance with reference voltages respectively input to first and second terminals of the operational amplifier; and a start-up circuit configured to initiate operation of the operational amplifier when the start-up circuit switches from an idle mode to an active mode, the start-up circuit comprising a first transistor having a gate connected to an output of the operational amplifier, a source connected to a supply voltage, and a drain connected to a first resistor, the first transistor having a first conductivity type and being configured to supply a constant reference current to the first resistor in accordance with an output voltage from the operational amplifier, thereby generating the reference voltage (e.g., a band-gap output voltage).

The start-up circuit may further comprise a low pass filter comprising a second transistor having the first conductivity type and a capacitive device. In one embodiment, the low pass filter may be configured to remove radio-frequency noise from the reference (e.g., band-gap output) voltage. The start-up circuit can also comprise a third transistor having a second conductivity type, configured to control the reference (e.g., band-gap output) voltage at about 0V in the idle mode. In particular, the second transistor may have a gate and a source, the source being connected between the drain of the first transistor and the first resistor, and a drain connected to the capacitive device. The capacitive device transistor may comprise a fourth transistor having a source connected to a ground voltage and a drain connected to the ground voltage.

The start-up circuit may further comprise a fifth transistor having the first conductivity type, a source connected to the supply voltage and a drain connected to the second transistor, the fifth transistor turning on when the start-up circuit switches from the idle mode to the active mode, a sixth transistor having the second conductivity type, a drain connected to the drain of the second transistor, the sixth transistor having a gate controlled by the reference (e.g., bandgap output) voltage when the start-up circuit is in the active mode, a seventh transistor having the second conductivity type, a gate connected to the drain of the fifth transistor and the drain of the sixth transistor, and a drain connected to the output of the operational amplifier, the seventh transistor being receiving a voltage from the drain of the sixth transistor, and eighth and ninth transistors each having the second conductivity type and turning on when the start-up circuit is in the active mode. In one embodiment, the eighth and ninth transistors are simultaneously turned on by the inverted power-down signal. The sixth transistor may have a gate connected to the drain of the fifth transistor, and a source connected to a drain of the eighth transistor. The seventh transistor may have a source connected to a drain of the ninth transistor. Each of the eighth and ninth transistors may have a source connected to the ground voltage. The eighth and ninth transistors may be turned off by the inverted power-down signal in the idle mode. The sixth transistor may be turned off by the reference (e.g., band-gap output) voltage in the idle mode.

The reference voltage generation circuit may further comprise tenth and eleventh transistors each having a source connected to the supply voltage and outputting a bias current corresponding to the output voltage from the operational amplifier, using the supply voltage; a reference voltage circuit connected to the first and second terminals of the operational amplifier at first and second nodes, respectively, the reference voltage circuit being configured to supply the reference voltages to the first and second terminals of the operational amplifier using the bias currents from the tenth and eleventh transistors, respectively, and a twelfth transistor having a source connected to the supply voltage and (optionally) a gate connected to a stage supplying the inverted power-down signal, the twelfth transistor supplying the supply voltage to the tenth and eleventh transistors when the reference voltage generation circuit is in the idle mode. In particular, each of the tenth and eleventh transistors may have a gate connected to the output of the operational amplifier. The tenth transistor may have a drain connected to the first node of the reference voltage circuit. The eleventh transistor may have a drain connected to the second node of the reference voltage circuit. The twelfth transistor may have a drain connected to the gates of the tenth and eleventh transistors. The reference voltage circuit may further comprise a second resistor and a first bipolar transistor connected in parallel to the first node and the ground voltage, a third resistor and a second bipolar transistor connected in parallel to the second node and the ground voltage, and a fourth resistor connected in series between the second node and the second bipolar transistor. The first and second bipolar transistors may have bases connected to the ground voltage, to constitute a current mirror. The first bipolar transistor may have an emitter connected to the first node, and a collector connected to the ground voltage, and the second bipolar transistor has an emitter connected to the fourth resistor, and a collector connected to the ground voltage. The twelfth transistor may be turned on in the idle mode, in which case the output of the operational amplifier may be brought to the supply voltage, so that the tenth and eleventh transistors may turn off. The first transistor may supply a substantially constant (or reference) current to the first resistor, to generate the reference (e.g., band-gap output) voltage having a predetermined value (e.g., of 1.2V). The first conductivity type may be P type, and the second conductivity type may be N type.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and along with the description serve to explain the principle(s) of the invention. In the drawings.

DETAILED DESCRIPTION

Reference will now be made in detail to various embodiments of the present invention, examples of which are illustrated in the accompanying drawings.

Hereinafter, configurations and operations according to the present invention will be described in detail in conjunction with embodiments of the present invention. Although the configurations and functions of the present invention are illustrated in the accompanying drawings, in conjunction with at least one embodiment, and described with reference to the accompanying drawings and the embodiments, the technical idea of the present invention and the important configurations and functions thereof are not limited thereto.

Hereinafter, various embodiments of a reference voltage generation circuit according to the present invention will be described with reference to the accompanying drawings.

Figure 1:
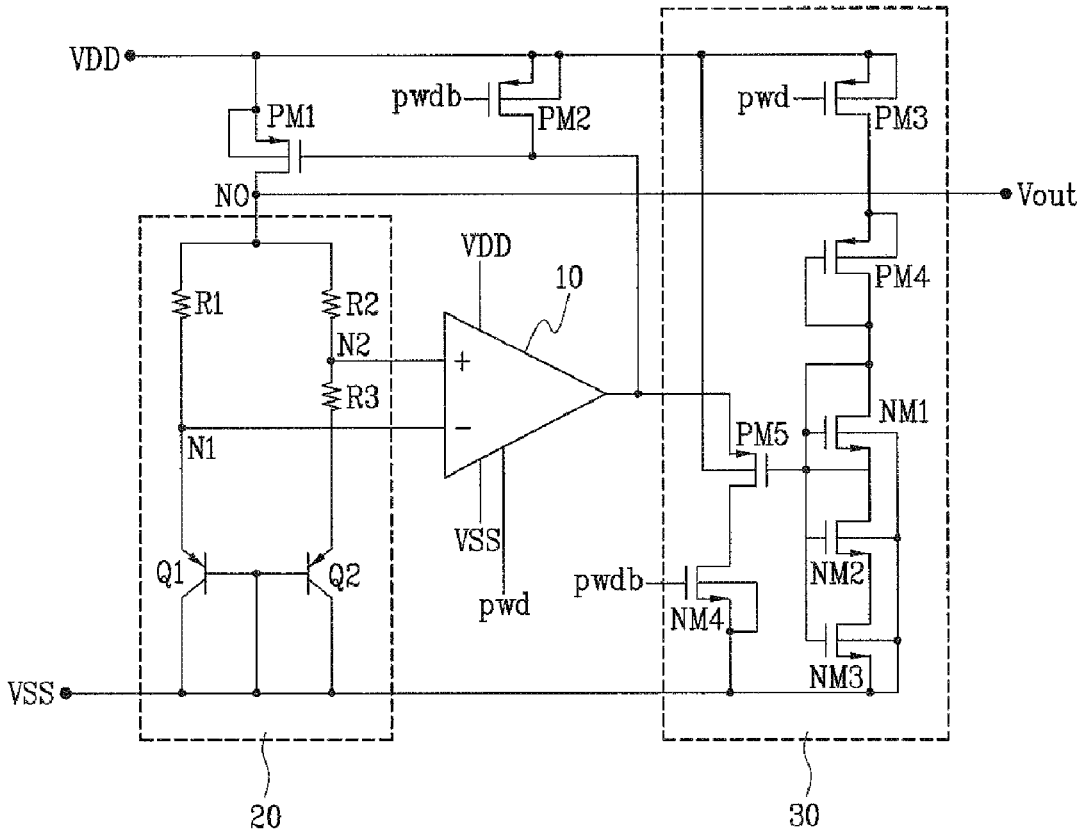
FIG. 1 is a circuit diagram illustrating a related band-gap reference voltage generation circuit.
Figure 2:
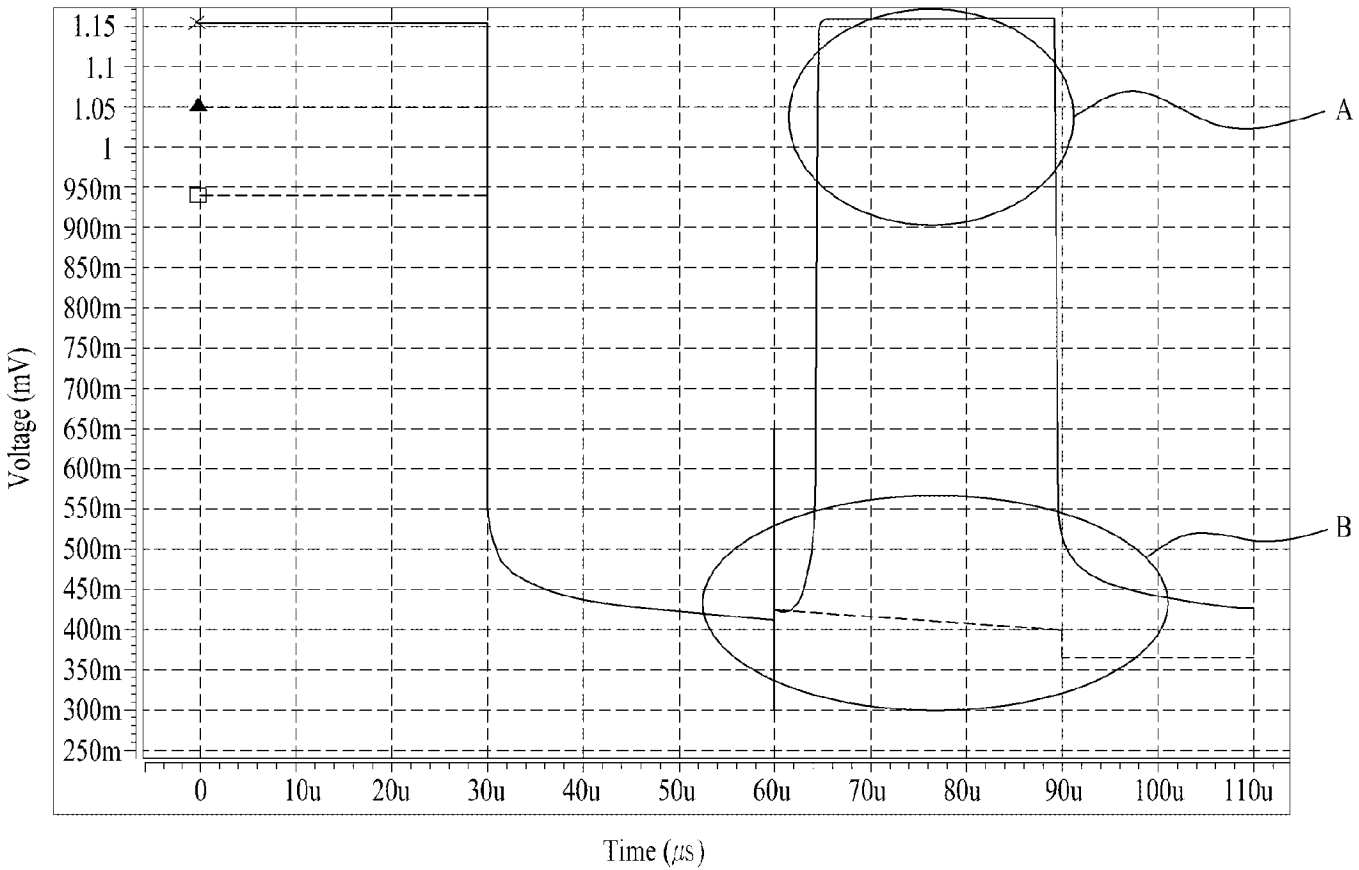
FIG. 2 is a graph depicting band-gap output voltage characteristics of the related band-gap reference voltage generation circuit exhibited when the input transistors of an operational amplifier are mismatched.
Figure 3:
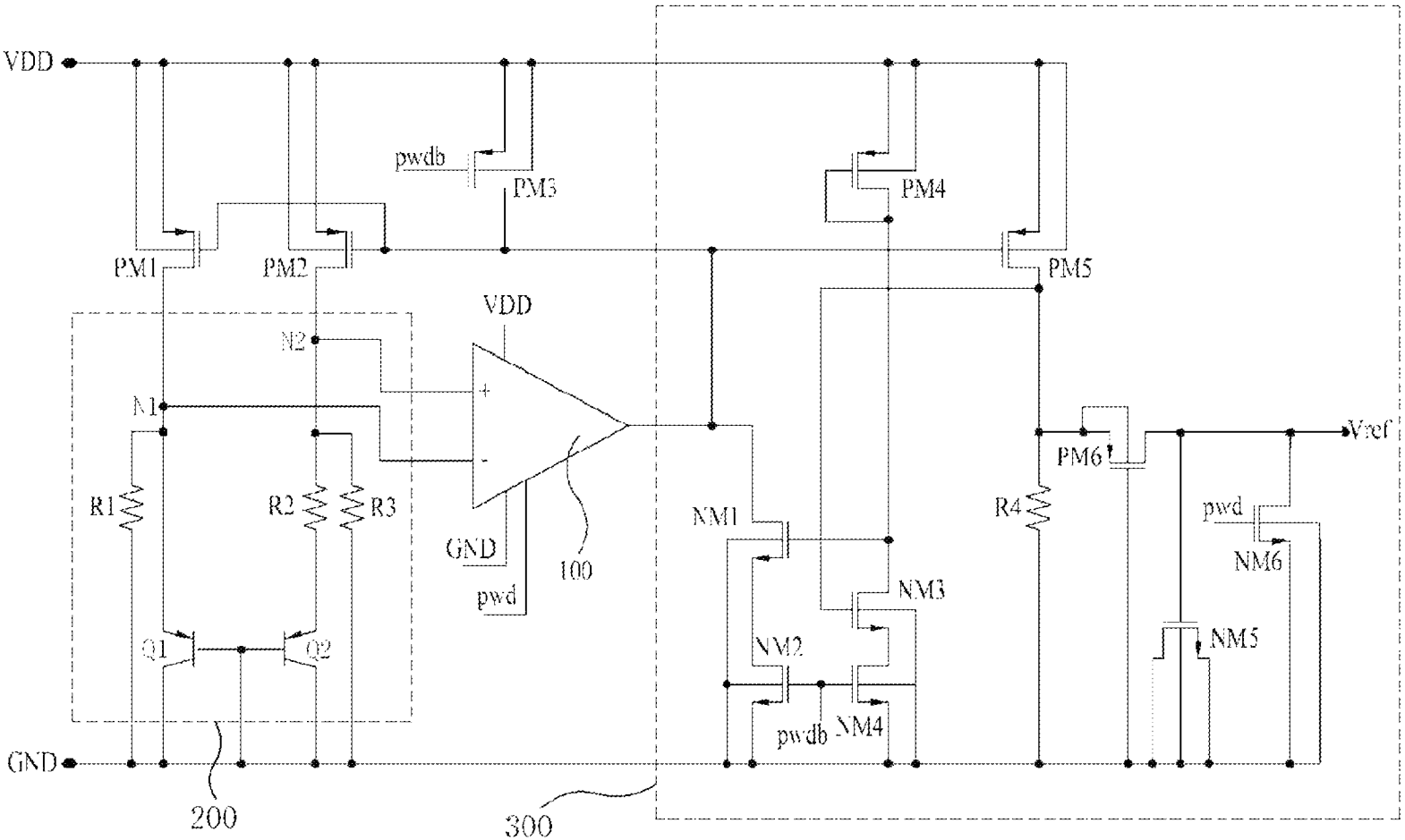
FIG. 3 is a circuit diagram illustrating a reference voltage generation circuit according to an exemplary embodiment of the present invention.

FIG. 3 is a circuit diagram illustrating a reference voltage generation circuit according to an exemplary embodiment of the present invention. In particular, the reference voltage generation circuit of the present invention may be a band-gap reference voltage generation circuit.

Referring to FIG. 3, the reference voltage generation circuit includes an operational amplifier 100 configured to output a substantially constant voltage in accordance with reference voltages respectively input to a first (e.g., lower or inverting) terminal (−) thereof and a second (e.g., upper or non-inverting) terminal (+) thereof, a reference voltage circuit 200 configured to supply the reference voltages to the first terminal (−) and second terminal (+) of the operational amplifier 100, respectively, and a start-up circuit 300 configured to initiate operation of the operational amplifier 100 when the start-up circuit 300 switches from an idle mode to an active mode.

The reference voltage generation circuit also includes PMOS transistors PM1 and PM2 configured to output bias currents corresponding to the output voltage from the operational amplifier 100, using a supply voltage VDD, and another PMOS transistor PM3 configured to supply the supply voltage VDD to the gates of PMOS transistors PM1 and PM2 in the idle mode, thereby turning off PMOS transistors PM1 and PM2 in the idle mode.

Each of the PMOS transistors PM1 and PM2 is connected, at the source thereof, to the supply voltage VDD, and is connected, at the gate thereof, to an output of the operational amplifier 100.

The PMOS transistor PM1 is connected, at the drain thereof, to a first node N1 of the reference voltage circuit 200. The first node N1 is connected to the first terminal (−) of the operational amplifier 100.

The PMOS transistor PM2 is connected, at the drain thereof, to a second node N2 of the reference voltage circuit 200. The second node N2 is connected to the second terminal (+) of the operational amplifier 100.

The PMOS transistor PM3 is connected, at the drain thereof, to both the gates of the PMOS transistors PM1 and PM2.

The reference voltage circuit 200 supplies reference voltages to the first terminal (−) and second terminal (+) of the operational amplifier 100 via the first and second nodes N1 and N2, using bias currents output from the PMOS transistors PM1 and PM2, respectively.

The PMOS transistor PM3 is connected, at the source thereof, to the supply voltage VDD, and is connected, at the gate thereof, to a stage configured to provide an inverted power-down signal pwdb. Thus, the PMOS transistor PM3 couples the supply voltage VDD to the PMOS transistors PM1 and PM2 in accordance with the inverted power-down signal pwdb. The signal pwdb represents a signal inverted from a power-down signal pwd having, in one embodiment, an active high binary logic state. When the signal pwd has a high level, the signal pwdb has a low level. On the other hand, when the signal pwd has a low level, the signal pwdb has a high level.

The start-up circuit 300 includes a PMOS transistor PM5 configured to supply a constant reference current to a resistor R4 connected to the drain of the PMOS transistor PM5 in accordance with the output voltage from the operational amplifier 100, to generate a band-gap output voltage Vref. In the exemplary embodiment shown in FIG. 3, the output voltage Vref is effectively a divided voltage. As a result, the series-connected PMOS transistor PM5 and resistor R4 may function as a voltage divider.

The PMOS transistor PM5 is connected, at the gate thereof, to the output of the operational amplifier 100, and is connected, at the source thereof, to the supply voltage VDD.

The start-up circuit 300 further includes a low pass filter and an NMOS transistor NM6 configured to prevent consumption of power. The low pass filter and NMOS transistor NM6 are arranged at the output of the start-up circuit 300.

The low pass filter includes a PMOS transistor PM6 and an NMOS transistor NM5, and functions to remove radio-frequency noise from the band-gap output voltage Vref.

In particular, the PMOS transistor PM6 of the low pass filter is connected, at the source thereof, between the drain of the PMOS transistor PM5 and the resistor R4. The source of the PMOS transistor PM6 may be connected to the gate of the PMOS transistor PM6, or (as shown in FIG. 3) to the ground voltage GND. The body of the PMOS transistor PM6 may be connected to the drain of the PMOS transistor PM5. The PMOS transistor PM6 is also connected, at the drain thereof, to the gate of the NMOS transistor NM5. The output of PMOS transistor PM6 can be the reference voltage Vref generated by the exemplary reference voltage generation circuit. Thus, the PMOS transistor PM6 may be configured as (or replaced with) a resistive device (e.g., a resistor). The source and drain of the NMOS transistor NM5 are connected to the ground voltage GND. Thus, the NMOS transistor NM5 may be configured as (or replaced with) a capacitive device (e.g., a capacitor).

The NMOS transistor NM6 is connected to the output of the reference voltage generation circuit. The NMOS transistor NM6 functions to pull the band-gap output voltage Vref to about 0V, thereby preventing the entire circuit from consuming power, when the reference voltage generation circuit is in the idle mode. The NMOS transistor NM6 is driven in accordance with the power-down signal pwd. The source (and optionally, the body) of the NMOS transistor NM6 is connected to the ground voltage GND.

When the start-up circuit 300 is switched from the idle mode to the active mode (normal mode) or from the active mode to the idle mode, the operational amplifier 100 has relatively stable wake-up points for the input and output thereof. To this end, the start-up circuit 300 can include, in addition to the PMOS transistor PM3, a PMOS transistor PM4, and four NMOS transistors NM1, NM2, NM3, and NM4.

The PMOS transistor PM4 is turned on when the start-up circuit 300 is switched from the idle mode to the active mode.

The PMOS transistor PM4 is connected, at the source thereof, to the supply voltage VDD. The gate and drain of the PMOS transistor PM4 are connected to each other. The PMOS transistor PM4 may function to regulate the voltage or bias applied to the gate of NMOS transistor NM1 (which, in turn, can function to regulate or control the voltage or bias applied to the gates of PMOS transistors PM1 and PM2).

The NMOS transistor NM3 is turned off (or, alternatively, biased at a relatively constant voltage) when the start-up circuit is switched from the idle mode to the active mode.

The NMOS transistor NM3 is connected, at the drain thereof, to the drain of the PMOS transistor PM4. Accordingly, when the NMOS transistor NM3 is turned off, the supply voltage VDD is charged for the drain voltage of the NMOS transistor NM3. Alternatively, when the NMOS transistor NM3 is biased at a relatively constant voltage, the drain voltage of the NMOS transistor NM3 is also held at a relatively constant bias or voltage.

The NMOS transistor NM1 is connected, at the gate thereof, to both the drains of the PMOS transistor PM4 and NMOS transistor NM3. The drain of the NMOS transistor NM1 is connected to the output of the operational amplifier 100. Thus, the NMOS transistor NM1 is turned on or biased by the voltage at the drain of the NMOS transistor NM3.

The NMOS transistors NM2 and NM4 are simultaneously turned on by the inverted power-down signal pwdb when the start-up circuit 300 is switched from the idle mode to the active mode.

The gates of the NMOS transistors NM2 and NM4 are connected in common to the supply stage or circuit providing the inverted power-down signal pwdb.

Hereinafter, the connection structures of the four NMOS transistors NM1, NM2, NM3, and NM4 will be described in more detail. The gate of the NMOS transistor NM3 is connected to the drain of the PMOS transistor MP5. The source of the NMOS transistor NM3 is connected to the drain of the NMOS transistor NM4. The source of the NMOS transistor NM1 is connected to the drain of the NMOS transistor NM2. The sources of the NMOS transistors NM2 and NM4 are connected to the ground voltage GND.

Thus, when the start-up circuit 300 switches from the idle mode to the active mode, the output from the operational amplifier 100 may discharged from an initial level (e.g., the level of the supply voltage VDD) to a wake-up level (e.g., VDD-1V), corresponding to a desired wake-up point of the reference voltage generation circuit. Depending on the desired value of the reference voltage Vref, the wake-up level may be from 0.1×VDD to 0.9×VDD, or any range of values therein (e.g., 0.3×VDD to 0.7×VDD, 0.4×VDD to 0.8×VDD, etc.).

When the start-up circuit 300 switches from the idle mode to the active mode, the PMOS transistor PM4, NMOS transistor NM3, NMOS transistor NM1, NMOS transistors NM2 and NM4, and operational amplifier 100 operate continuously until the band-gap output voltage Vref is stabilized (e.g., it reaches a predetermined value, such as 1.2V, 1.5 V, 1.8 V, etc.).

When the band-gap output voltage Vref reaches the predetermined value (e.g., 1.2V), the NMOS transistor NM3 is turned on or biased, so that the drain voltage of the NMOS transistor NM3 corresponds to about 0V. When the drain voltage of the NMOS transistor NM3 corresponds to 0V, the NMOS transistor NM1 is turned off. At this time, the start-up circuit 300 may cease operation.

On the other hand, when the start-up circuit 300 is in an idle mode, the NMOS transistors NM2 and NM4 are turned off by the inverted power-down signal pwdb. Also, the NMOS transistor NM3 is turned off by the band-gap output voltage Vref, which is about 0V in the idle mode. As a result, the total current consumption of the reference voltage generation circuit in the idle mode is close to or about 0 μA.

The reference voltage circuit 200 includes resistors R1, R2, and R3, and bipolar transistors Q1 and Q2. Hereinafter, the structure of the reference voltage circuit 200 will be described in conjunction with the first node N1 connected to the first terminal (−) of the operational amplifier 100 and the second node N2 connected to the second terminal (+) of the operational amplifier 100.

The resistor R1 and first bipolar transistor Q1 are connected in parallel to the first node N1 and ground voltage GND.

The resistor R3 and second bipolar transistor Q2 are connected in parallel to the second node N2 and ground voltage GND. The resistor R2 is connected between the second node N2 and the second bipolar transistor Q2.

The first and second bipolar transistors Q1 and Q2 are connected, at the bases thereof, to the ground voltage GND such that they constitute a current mirror. The first bipolar transistor Q1 is connected, at the emitter thereof, to the first node N1, and is connected, at the collector thereof, to the ground voltage GND. The second bipolar transistor Q2 is connected, at the emitter thereof, to the resistor R2, and is connected, at the collector thereof, to the ground voltage GND.

The PMOS transistor PM3 is turned on when the start-up circuit 300 is in the idle mode. As the PMOS transistor PM3 is turned on, the output of the operational amplifier 100 is brought to the supply voltage VDD. As a result, the PMOS transistors PM1 and PM2 are turned off.

In the above-described reference voltage generation circuit, the PMOS transistor PM5 supplies a constant reference current to the resistor R4, thereby generating a band-gap output voltage Vref having a predetermined value (e.g., of 1.2V or other value between ground and VDD, which may be 3V, 3.3V, 5V, etc.). In particular, when the start-up circuit 300 is switched from the idle mode to the active mode, the band-gap output voltage Vref is rapidly set to the predetermined value (e.g., 1.2V), and is then maintained at a certain level thereafter (e.g., the predetermined value).

Figure 4:
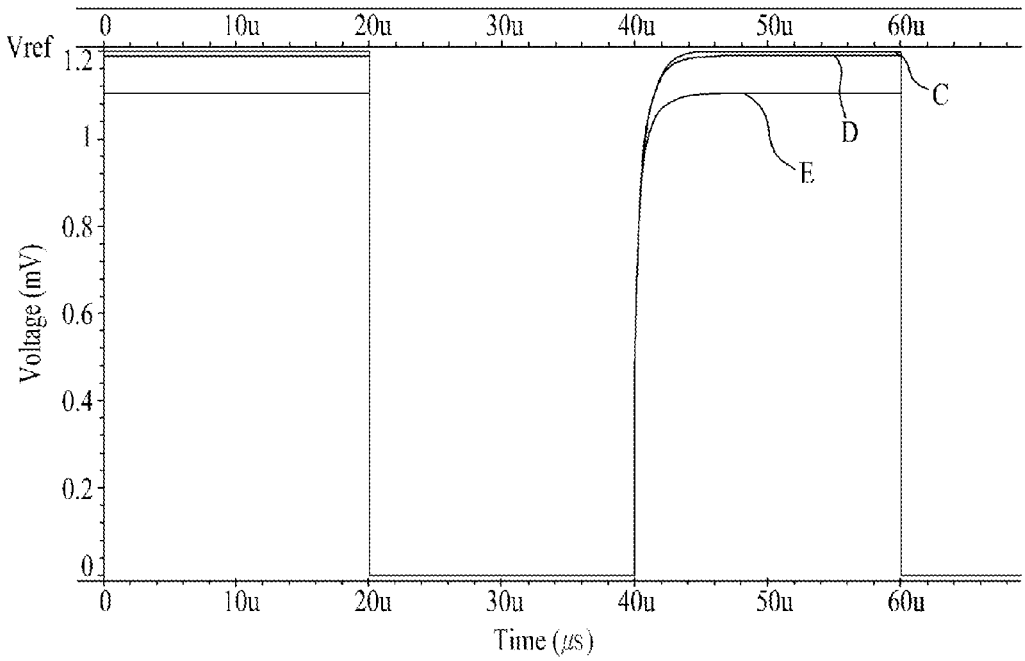
FIG. 4 is a graph depicting a band-gap output from an exemplary band-gap reference voltage generation circuit according to simulations.

FIG. 4 is a graph depicting the band-gap output from the exemplary band-gap reference voltage generation circuit according to simulations.

Referring to FIG. 4, it can be seen that the operational amplifier 100 outputs a stable band-gap reference voltage D or E even when the two input transistors of the operational amplifier 100 are manufactured by a process causing a mismatch of 0.11 (1.1 mV) or 1% (10 mV).

Meanwhile, "C" in FIG. 4 represents a band-gap output generated when the two input transistors of the operational amplifier 100 are matched (e.g., a mismatch of 0% [0 mV]).

The reference voltage generation circuit according to the present invention can be used for a band-gap reference voltage generation circuit, and can provide the following effects.

First, it is possible to achieve an improvement in stability by reducing the wake-up time during start-up of the reference voltage generation circuit.

Second, it is possible to achieve a stable start-up output when the operation mode switches from idle to active (e.g., normal mode), and thus to rapidly obtain a stable output voltage.

Third, it is possible to output a stable band-gap reference voltage (e.g., of 1.2V or other predetermined value) when the operation mode switches from idle to active, even when the two input transistors of the operational amplifier have a mismatch of up to 1% (or more), and thus to achieve an improvement in the stability of the band-gap output.

Fourth, it is possible to achieve a normal wake-up when the operation mode switches from idle to active, even when the resistors and bipolar transistors at the input stages of the operational amplifier have a mismatch of up to 30% (or possibly more).

It will be apparent to those skilled in the art that various modifications and variations can be made in the present invention without departing from the spirit or scope of the inventions. Thus, it is intended that the present invention covers the modifications and variations of this invention provided they come within the scope of the appended claims and their equivalents.

What is claimed is:

1. A reference voltage generation circuit comprising:

an operational amplifier configured to output a substantially constant voltage in accordance with first and second voltages respectively input into first and second terminals of the operational amplifier;

a start-up circuit configured to initiate operation of the operational amplifier when the start-up circuit switches from an idle mode to an active mode, the start-up circuit comprising:

(i) a first transistor having a gate connected to an output of the operational amplifier, a source connected to a supply voltage, and a drain connected to a first resistor, to supply a substantially constant reference current to the first resistor in accordance with the output voltage from the operational amplifier, thereby generating the reference voltage;

(ii) a second transistor having the first conductivity type and a source connected to the supply voltage, the second transistor turning on when the start-up circuit switches from the idle mode to the active mode;

(iii) a third transistor having a second conductivity type and a drain connected to the drain of the second transistor, the third transistor having a gate controlled by the reference voltage;

(iv) a fourth transistor having the second conductivity type, a gate connected to the drain of the second transistor and the drain of the third transistor, and a drain connected to the output of the operational amplifier; and (v) fifth and sixth transistors each having the second conductivity type, the fifth and sixth transistors being turned on in the active mode.

2. The reference voltage generation circuit according to claim 1, further comprising a low pass filter comprising a seventh transistor and a capacitive device, the first and seventh transistors having a first conductivity type, and the low pass filter being configured to remove noise from the reference voltage.

3. The reference voltage generation circuit according to claim 2, wherein the seventh transistor has a gate, a source connected between the drain of the first transistor and the first resistor, and a drain connected to the capacitive device.

4. The reference voltage generation circuit according to claim 2, wherein the capacitive device comprises an eighth transistor having the second conductivity type.

5. The reference voltage generation circuit according to claim 1, wherein the start-up circuit further comprises a power-down transistor configured to hold the reference voltage to about 0V in the idle mode.

6. The reference voltage generation circuit according to claim 1, wherein the third transistor has a gate connected to the drain of the first transistor, and a source connected to a drain of the fifth transistor.

7. The reference voltage generation circuit according to claim 1, wherein the fourth transistor has a source connected to a drain of the sixth transistor.

8. The reference voltage generation circuit according to claim 1, wherein each of the fifth and sixth transistors has a source connected to a ground voltage.

9. The reference voltage generation circuit according to claim 1, wherein the fifth and sixth transistors are turned off in the idle mode, and the third transistor is turned off by the reference voltage in the idle mode.

10. The reference voltage generation circuit according to claim 1, further comprising:

first and second bias transistors each having the first conductivity type and a source connected to the supply voltage, each of the first and second bias transistors outputting a bias current corresponding to the output voltage from the operational amplifier; and a reference voltage circuit connected to the first and second terminals of the operational amplifier at first and second nodes, respectively, configured to supply the reference voltages to the first and second terminals of the operational amplifier using the bias currents output from the first and second bias transistors, respectively.

11. The reference voltage generation circuit according to claim 10, further comprising a turn-off transistor having a source connected to the supply voltage, the turn-off transistor supplying the supply voltage to the first and second bias transistors when the reference voltage generation circuit is in the idle mode.

12. The reference voltage generation circuit according to claim 11, wherein:

each of the first and second bias transistors has a gate connected to the output of the operational amplifier;

the first bias transistor has a drain connected to the first node of the reference voltage circuit; and the second bias transistor has a drain connected to the second node of the reference voltage circuit.

13. The reference voltage generation circuit according to claim 11, wherein the turn-off transistor has a drain connected to the gates of the first and second bias transistors.

14. The reference voltage generation circuit according to claim 11, wherein the reference voltage circuit further comprises:

a second resistor and a first bipolar transistor connected in parallel to the first node and the ground voltage;

a third resistor and a second bipolar transistor connected in parallel to the second node and the ground voltage; and a fourth resistor connected in series between the second node and the second bipolar transistor.

15. The reference voltage generation circuit according to claim 14, wherein:

the first and second bipolar transistors have bases connected to the ground voltage;

the first bipolar transistor has an emitter connected to the first node, and a collector connected to the ground voltage; and the second bipolar transistor has an emitter connected to the fourth resistor, and a collector connected to the ground voltage.

16. The reference voltage generation circuit according to claim 11, wherein the turn-off transistor is on in the idle mode, and the output of the operational amplifier has the supply voltage when the twelfth transistor is on.

17. The reference voltage generation circuit according to claim 1, wherein the first transistor supplies a substantially constant current to the first resistor, to generate a predetermined output voltage.

18. The reference voltage generation circuit according to claim 1, wherein the first conductivity type is P type, and the second conductivity type is N type.

* * * * *